US006125168A

United States Patent [19]

Bhatt

[11] Patent Number: 6,125,168

[45] **Date of Patent: *Sep. 26, 2000**

[54] X-RAY TUBE ROTOR AND STATOR ASSEMBLY

[75] Inventor: Vivek Bhatt, Schenectady, N.Y.

[73] Assignee: General Electric Company, Schenectady, N.Y.

[ * ] Notice: This patent is subject to a terminal disclaimer.

[21] Appl. No.: 09/134,113

[22] Filed: Aug. 14, 1998

Related U.S. Application Data

[63] Continuation-in-part of application No. 08/925,294, Sep. 8, 1997, Pat. No. 5,875,227.

[51] Int. Cl.[7] ..... H01J 35/10

[52] U.S. Cl. ..... 378/132; 378/133

[58] Field of Search ..... 378/127, 130, 378/132, 133, 139, 141, 144, 199, 200, 201

[56] References Cited

U.S. PATENT DOCUMENTS

| | | | |
|---|---|---|---|
| 3,694,685 | 9/1972 | Houston | 313/60 |
| 4,852,140 | 7/1989 | Dax | 378/132 |
| 5,483,570 | 1/1996 | Renshaw et al. | 378/132 |
| 5,541,975 | 7/1996 | Anderson et al. | 378/130 |
| 5,668,849 | 9/1997 | Sugiura et al. | 378/133 |
| 5,875,227 | 2/1999 | Bhatt | 378/132 |

*Primary Examiner*—David P. Porta
*Attorney, Agent, or Firm*—Marvin Snyder; Douglas E. Stoner

[57] ABSTRACT

An X-ray tube assembly having bearings rotatably connecting a rotor shaft and a stator. A pair of circumferential protrusions each radially extend from the shaft and are spaced apart a first radial distance from the stator. In a first example, the protrusions are longitudinally outward of, and to one longitudinal side of, the pair of bearings, and one of the protrusions is longitudinally and radially proximate one of the bearings. In a second example, a line may be drawn which is parallel to the axis and which intersects each of the protrusions and each of the bearings. A substance, which includes metal (such as gallium) and which is liquid at the assembly's operating temperature, is located longitudinally between the circumferential protrusions. The substance radially extends a second radial distance between, and in conductive thermal contact with, the shaft and the stator.

7 Claims, 3 Drawing Sheets

X-RAY TUBE ROTOR AND STATOR ASSEMBLY

CROSS-REFERENCE TO RELATED APPLICATIONS

The present patent application is a continuation-in-part application of U.S. patent application Ser. No. 08/925,294 by Vivek Bhatt which is entitled "X-Ray Tube Rotor and Stator Assembly", which was filed Sep. 8, 1997, and which issued as U.S. Pat. No. 5,875,227 on Feb. 23, 1999.

FIELD OF THE INVENTION

The present invention relates generally to X-ray tubes, and more particularly to a rotor and stator assembly for an X-ray tube.

BACKGROUND OF THE INVENTION

X-ray equipment used in the medical field typically includes a rotating anode X-ray tube. Such X-ray tubes are vacuum tubes each including a rotor having a rotatable shaft and each also including a stator which circumferentially surrounds, or is circumferentially surrounded by, the rotatable shaft. A pair of bearings, such as rolling element bearings (e.g., ball bearings), is positioned radially between the shaft and the stator. An X-ray target, which typically is attached to the rotatable shaft, is heated to high temperatures by the impinging electrons emitted by the cathode. The bearings are poor thermal conductors which sets up a temperature differential between the shaft side and the stator side of the bearings causing bearing misalignment and wear which shortens the operating life of the X-ray tube. During rotation, the bearings are prone to electrical arcing which is a disadvantage in designs requiring a stable electrical path between the shaft and the stator. Known designs include those which use bearings for rotational support and which also use liquid metal (such as gallium) in the annularly-cylindrical gap between the shaft and the stator to conduct heat and electricity. Such liquid metal equalizes the temperature on both sides of the bearing which increases bearing life, but such designs are prone to leakage of the liquid metal out of the gap with such escaped liquid metal causing high voltage instability which shortens the operating life of the X-ray tube.

What is needed, for X-ray tubes employing liquid metal for thermal and/or electrical conduction purposes, is an improved X-ray tube design which prevents leakage of the liquid metal from the gap between the shaft and the stator.

SUMMARY OF THE INVENTION

In a first exemplary embodiment, the X-ray tube assembly of the invention has a rotor, a stator, a pair of bearings, a pair of circumferential protrusions, and a substance which includes metal and which is liquid at the assembly's operating temperature. The rotor has a rotatable shaft with a generally longitudinally extending axis. The stator is generally coaxially aligned with the axis and is radially spaced apart from the shaft. The bearings are positioned radially between the shaft and the stator and are longitudinally spaced apart from each other by a first longitudinal distance. The circumferential protrusions each radially extend from one of the shaft or the stator and are radially spaced apart a first radial distance from the other of the shaft and the stator, and the circumferential protrusions are longitudinally spaced apart from each other by a second longitudinal distance. The circumferential protrusions are located longitudinally outward of, and to one longitudinal side of, the pair of bearings. One of the pair of circumferential protrusions is longitudinally and radially proximate one of the pair of bearings. The substance is longitudinally positioned between the circumferential protrusions and radially extends a second radial distance between, and in conductive thermal contact with, the shaft and the stator.

In a second exemplary embodiment, the X-ray tube assembly of the invention has a rotor, a stator, a pair of bearings, a pair of circumferential protrusions, and a substance which includes metal and which is liquid at the assembly's operating temperature. The rotor has a rotatable shaft with a generally longitudinally extending axis. The stator is generally coaxially aligned with the axis and is radially spaced apart from the shaft. The bearings are positioned radially between the shaft and the stator and are longitudinally spaced apart from each other by a first longitudinal distance. The circumferential protrusions each radially extend from one of the shaft or the stator and are radially spaced apart a first radial distance from the other of the shaft and the stator, and the circumferential protrusions are longitudinally spaced apart from each other by a second longitudinal distance. The pair of circumferential protrusions and the pair of bearings are positioned such that a line may be drawn which is parallel to the axis and which intersects each of the pair of protrusions and each of the pair of bearings. The substance is longitudinally positioned between the circumferential protrusions and radially extends a second radial distance between, and in conductive thermal contact with, the shaft and the stator.

Several benefits and advantages are derived from the invention. The circumferential protrusions provide good sealing for the liquid substance. Applicant's analysis surprisingly has found that leakage is essentially eliminated by making the second radial distance more than generally fifty times the first radial distance and by making the first radial distance between generally twenty microns and generally sixty microns. Upon reflection, Applicant believes that the larger second radial distance provides for a more gradual energy transition in the liquid substance from a region, adjacent the shaft, having generally the rotational speed of the shaft to a region, adjacent the stator, having no rotational speed. Hence, Applicant believes that there is less energy in the liquid substance adjacent the ends of the circumferential protrusions to cause leakage longitudinally across the circumferential protrusions as compared to known designs lacking such circumferential protrusions. Supplying the facing portion of each circumferential protrusion with an anti-wetting coating and with sealing grooves provides for even a more conservative no-leakage design. It is noted that the liquid metal containing substance acts as a thermal short circuit to equalize temperatures on both the shaft and stator sides of the bearings which increases the operating life of the X-ray tube assembly. It is also noted that the liquid metal containing substance works as an electrical short circuit to provide a constant stable electrical path which improves the high voltage performance of the tube.

DETAILED DESCRIPTION OF THE INVENTION

Figure 1:
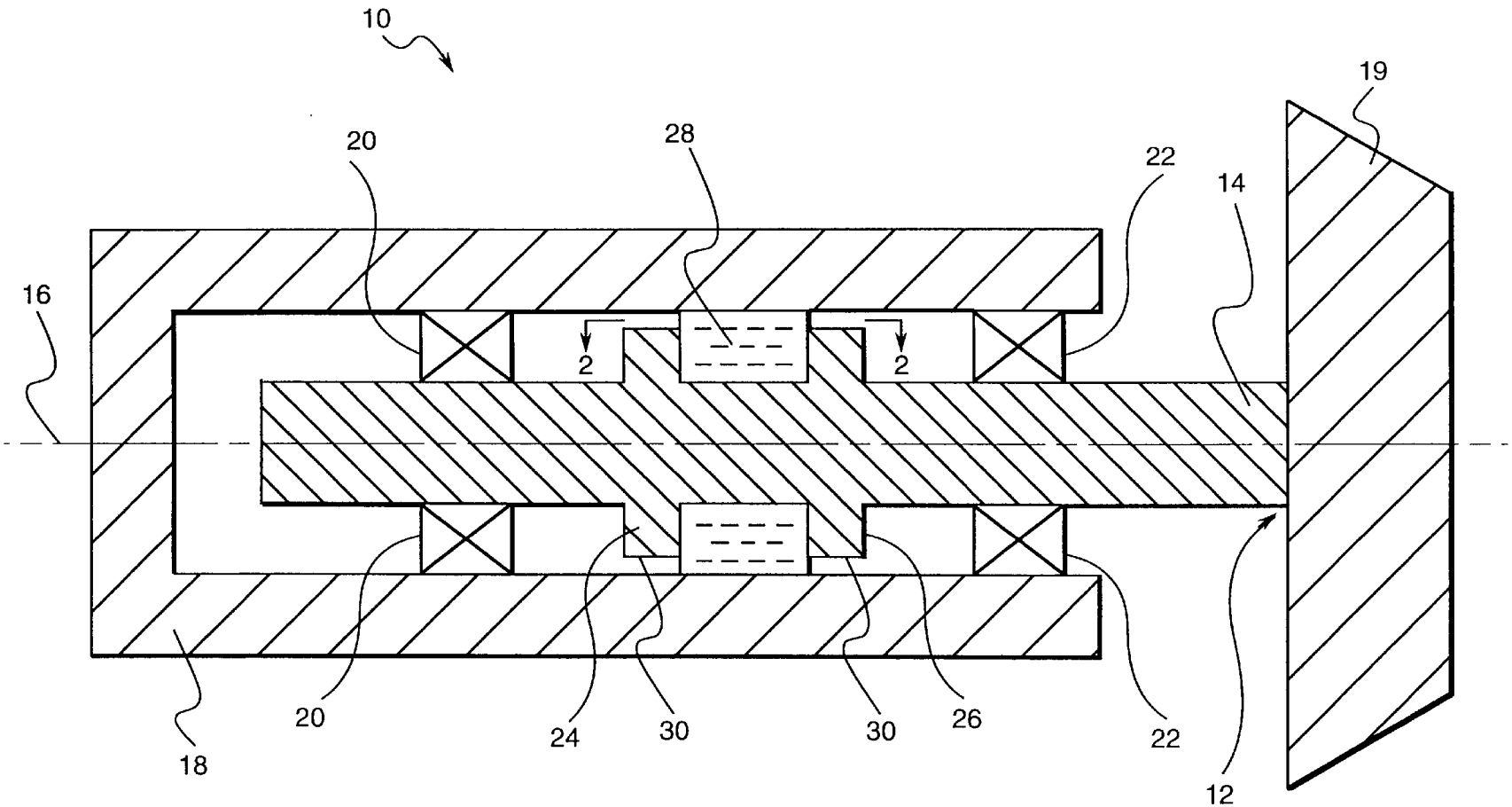
FIG. 1 is a schematic cross-sectional view of a first preferred embodiment of the X-ray tube assembly of the present invention.
Figure 2:
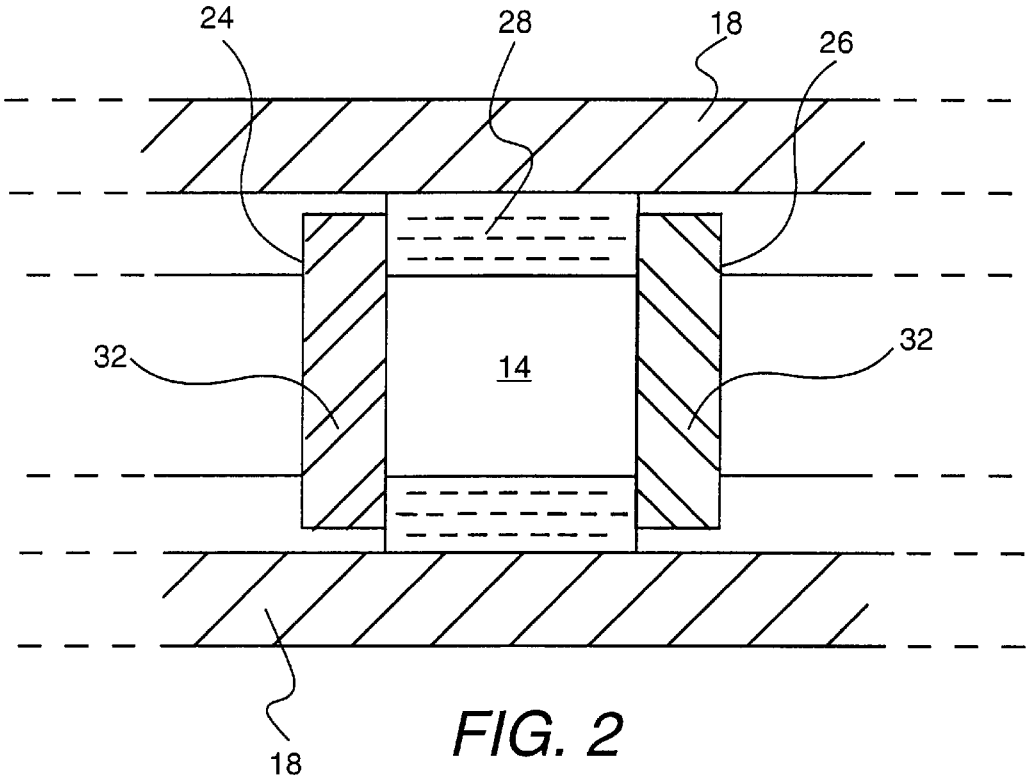
FIG. 2 is a view taken along lines 2—2 of FIG. 1 showing the sealing grooves on the circumferential protrusions.

Referring now to the drawings, wherein like numerals represent like elements throughout, FIGS. 1 and 2 schematically show a first preferred embodiment of the X-ray tube assembly 10 of the present invention. The X-ray tube assembly 10 has an operating temperature. The X-ray tube assembly 10 includes an X-ray tube rotor 12 having a rotatable shaft 14 with a generally longitudinally extending axis 16 and further includes an X-ray tube stator 18 generally coaxially aligned with the axis 16 and radially spaced apart from the shaft 14. Preferably, the stator 18 circumferentially surrounds the shaft 14. Other constructions, include, without limitation, those having the shaft circumferentially surrounding the stator and those having the rotor circumferentially surrounding one portion of the stator with another portion of the stator circumferentially surrounding the rotor, as can be appreciated by those skilled in the art. An X-ray tube target 19 is shown attached to an end of the shaft 14 in FIG. 1.

The X-ray tube assembly 10 also includes a pair of bearings 20 and 22 disposed radially between the shaft 14 and the stator 18, wherein the bearings 20 and 22 are longitudinally spaced apart from each other by a first longitudinal distance. Preferably, the bearings 20 and 22 are rolling element bearings. An exemplary rolling element bearing is a ball bearing. The type and composition of the bearings 20 and 22 are left to the artisan. For example, and without limitation, some applications may call for metal bearings while other applications may call for ceramic bearings.

The X-ray tube assembly 10 additionally includes a pair of circumferential protrusions 24 and 26 each radially extending from one of the shaft 14 and the stator 18 and radially spaced apart a first radial distance from the other of the shaft 14 and the stator 18, wherein the circumferential protrusions 24 and 26 are longitudinally spaced apart from each other by a second longitudinal distance. Preferably, each of the pair of circumferential protrusions 24 and 26 radially extends from the same one of the shaft 14 and the stator 18. It is preferred that each of the pair of circumferential protrusions 24 and 26 radially extends from the shaft 14. Other constructions include those having both circumferential protrusions radially extending from the stator and those having one circumferential protrusion radially extending from the shaft and the other circumferential protrusion radially extending from the stator. In an exemplary construction, the shaft 14 and the circumferential protrusions 24 and 26 together define a monolithic component, as shown in FIGS. 1 and 2. In a preferred construction, the circumferential protrusions 24 and 26 are disposed longitudinally between the bearings 20 and 22. It is noted that FIG. 1 shows the circumferential protrusions 24 and 26 at about the same radial distance from the axis 16 as the bearings 20 and 22. However, some shaft-stator configurations (such as, without limitation, the previously mentioned one having the rotor circumferentially surrounding one radially-inner portion of the stator with another radially-outer portion of the stator circumferentially surrounding the rotor) may have the circumferential protrusions at a different radial distance from the axis than the bearings (such as, in the previous example, having the circumferential protrusions located radially between the shaft and the radially-outer portion of the stator and having the bearings located radially between the shaft and the radially-inner portion of the stator).

The X-ray tube assembly 10 moreover includes a substance 28 (which may also be called a plug) which comprises metal and which is liquid at the operating temperature of the assembly 10, wherein the substance 28 is longitudinally disposed between the circumferential protrusions 24 and 26 and wherein the substance 28 radially extends a second radial distance between, and in conductive thermal contact with, the shaft 14 and the stator 18. Preferably, the substance 28 is liquid at room temperature. In an exemplary embodiment, the substance 28 consists essentially of (and preferably consists of) metal. The term "metal" includes, without limitation, mixtures and/or alloys. In an exemplary embodiment, the substance 28 includes gallium.

It is preferred that the second radial distance (in FIG. 1 the distance the substance 28 radially extends between, and in conductive thermal contact with, the shaft 14 and the stator 18) is greater than generally fifty times the first radial distance (in FIG. 1 the distance a circumferential protrusion 24 or 26 is radially spaced apart from the stator 18) for each of the pair of circumferential protrusions 24 and 26. It is also preferred that the first radial distance is between generally twenty microns and generally sixty microns for each of the pair of circumferential protrusions 24 and 26. In a preferred construction, the first longitudinal distance (the distance the bearings 20 and 22 are spaced apart) is greater than generally two times the second longitudinal distance (the distance the circumferential protrusions 24 and 26 are spaced apart). For uneven or slanted surfaces, it is understood that distances between objects are measured between points of closest approach.

Preferably, each of the pair of circumferential protrusions 24 and 26 has a portion which is facing the stator 18 and which is coated with an anti-wetting agent. 30. Anti-wetting agents are known to those skilled in the art of X-ray tubes having liquid metal bearings, and a preferred anti-wetting agent 30 is titanium dioxide. Also, preferably each of the pair of circumferential protrusions 24 and 26 has a portion which is facing the stator 18 and which includes sealing grooves 32. The direction of rotation of the shaft 14 about the axis 16, as seen in FIG. 2, has the top portion of the shaft 14 rotating out of the plane of the paper and the bottom portion of the shaft 14 rotating into the plane of the paper. Sealing grooves are also known to those skilled in the art of X-ray tubes having liquid metal bearings. It is noted that the sealing groove portion of the circumferential protrusions may be the same portion (as shown in FIGS. 1 and 2) or a different portion (such as a longitudinally adjacent portion having a different first radial distance) from that portion of the circumferential protrusions having the anti-wetting agent.

Figure 3:
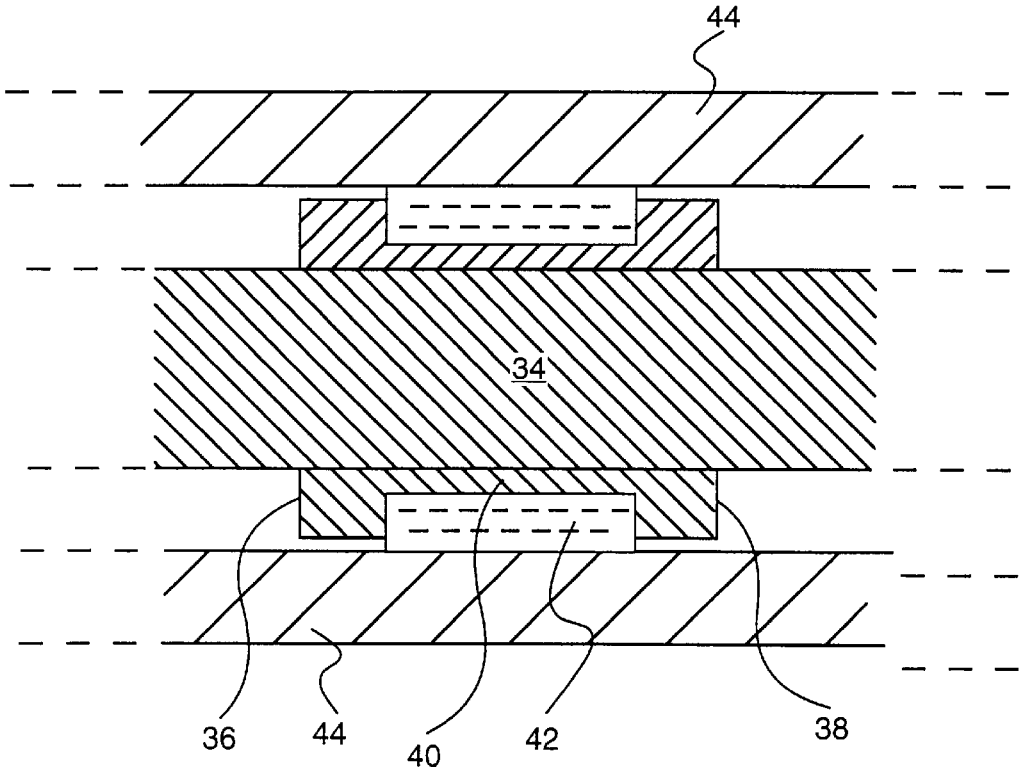
FIG. 3 is a view of an alternate embodiment of the circumferential protrusions and adjacent area shown in FIG. 1.

In an alternate embodiment, shown in FIG. 3, the shaft 34 is a discrete component from the circumferential protrusions 36 and 38, and the circumferential protrusions 36 and 38 together with an intervening base member 40 define a monolithic component. It is noted that in FIG. 3 the substance 42 radially extends a second radial distance between, and in conductive thermal contact with, the shaft 34 and the stator 44. Other design embodiments for the circumferential protrusions are left to the artisan.

Figure 4:
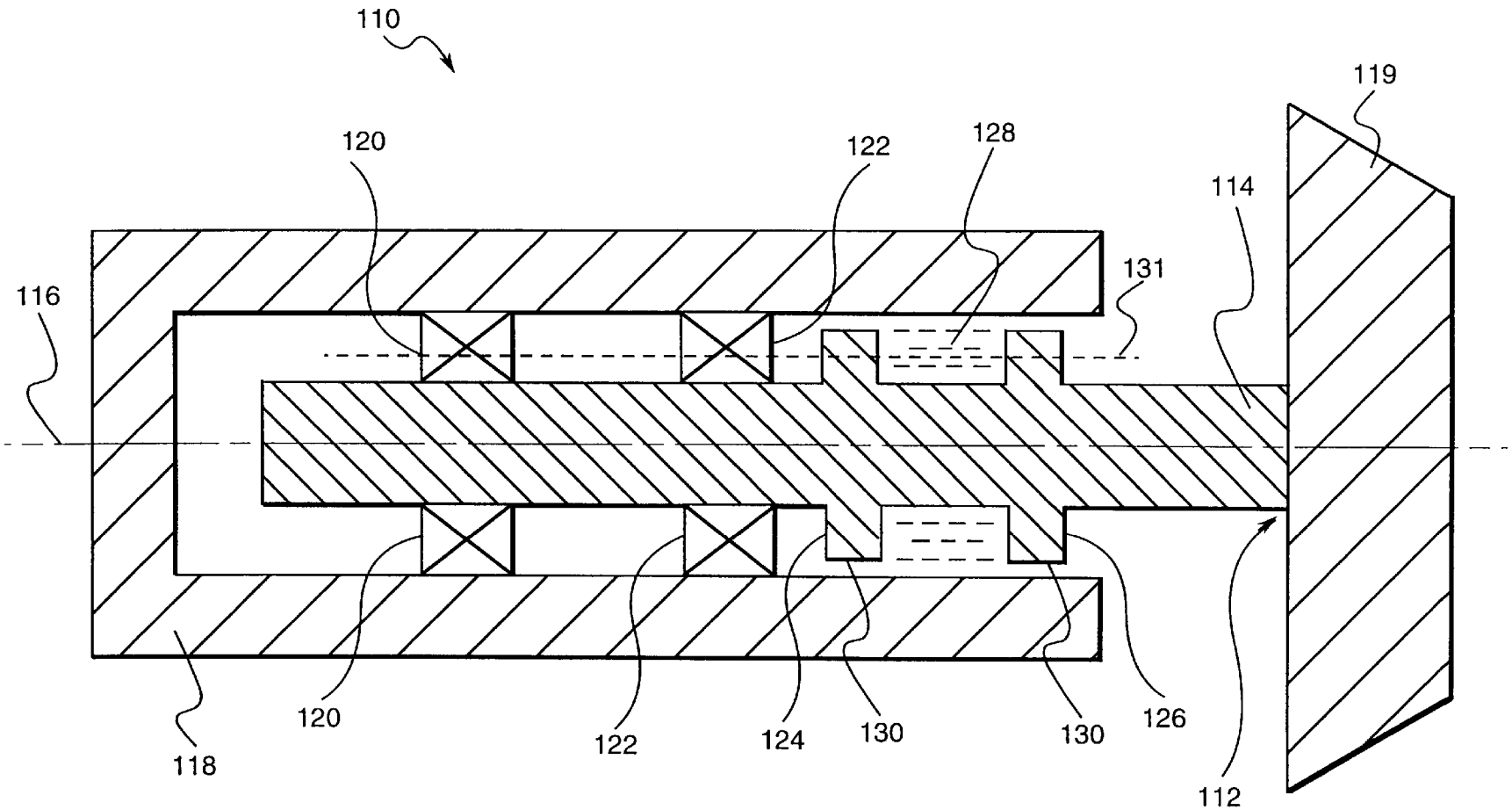
FIG. 4 is a view, as in FIG. 1, but of a second preferred embodiment of the X-ray tube assembly of the present invention.

In a second preferred embodiment shown in FIG. 4, the X-ray tube assembly 110 is identical to the previously described first preferred embodiment of the X-ray tube assembly 10 shown in FIG. 1 with differences as hereinafter noted. The parts of assembly 110, including the rotor 112, the shaft 114, the axis 116, the stator 118, the target 119, the bearings 120 and 122, the circumferential protrusions 124 and 126, the liquid metal containing substance 128, and the anti-wetting agent 130 are the same as their corresponding elements in assembly 10 except that in assembly 110, the circumferential protrusions 124 and 126 are not disposed longitudinally between the bearings 120 and 122. Instead, in a first exemplary embodiment, assembly 110 is described as having the circumferential protrusions 124 and 126 disposed longitudinally outward of, and to one longitudinal side of, the pair of bearings 120 and 122, and as having one of the pair of circumferential protrusions 124 be longitudinally and radially proximate one of the pair of bearings 122. Having one of the circumferential protrusions 124 in longitudinal and radial proximity to one of the bearings 122 will ensure that the liquid metal containing substance acts as a thermal short circuit to equalize temperatures on both the shaft 114 and stator 118 sides of the bearings 120 and 122 which increases the operating life of the X-ray tube assembly 110. In a second exemplary embodiment, assembly 110 is described as having the pair of circumferential protrusions 124 and 126 and the pair of bearings 120 and 122 disposed such that a line (such as dotted line 131) may be drawn which is parallel to the axis 116 and which intersects each of the pair of circumferential protrusions 124 and 126 and each of the pair of bearings 120 and 122.

The foregoing description of several preferred and exemplary embodiments of the invention has been presented for purposes of illustration. It is not intended to be exhaustive or to limit the invention to the precise form disclosed, and obviously many modifications and variations are possible in light of the above teaching. It is intended that the scope of the invention be defined by th e claims appended hereto.

What is claimed is:

1. An X-ray tube assembly having an operating temperature and comprising:

a) an X-ray tube rotor having a rotatable shaft with a generally longitudinally extending axis;

b) an X-ray tube stator generally coaxially aligned with said axis and radially spaced apart from said shaft;

c) a pair of bearings disposed radially between said shaft and said stator, wherein said bearings are longitudinally spaced apart from each other by a first longitudinal distance;

d) a pair of circumferential protrusions each radially extending from one of said shaft and said stator and radially spaced apart a first radial distance from the other of said shaft and said stator, wherein said circumferential protrusions are longitudinally spaced apart from each other by a second longitudinal distance, wherein said circumferential protrusions are disposed longitudinally outward of, and to one longitudinal side of, said pair of bearings, and wherein one of said pair of circumferential protrusions is longitudinally and radially proximate one of said pair of bearings; and e) a substance which comprises metal and which is liquid at said operating temperature, wherein said substance is longitudinally disposed between said circumferential protrusions and wherein said substance radially extends a second radial distance between, and in conductive thermal contact with, said shaft and said stator;

wherein said pair of protrusions and said pair of bearings are disposed such that a line may be drawn which is parallel to said axis and which intersects each of said pair of protrusions and each of said pair of bearings.

2. An X-ray tube assembly having an operating temperature and comprising:

a) an X-ray tube rotor having a rotatable shaft with a generally longitudinally extending axis;

b) an X-ray tube stator generally coaxially aligned with said axis and radially spaced apart from said shaft;

c) a pair of bearings disposed radially between said shaft and said stator, wherein said bearings are longitudinally spaced apart from each other by a first longitudinal distance;

d) a pair of circumferential protrusions each radially extending from one of said shaft and said stator and radially spaced apart a first radial distance from the other of said shaft and said stator, wherein said circumferential protrusions are longitudinally spaced apart from each other by a second longitudinal distance, and wherein said pair of circumferential protrusions and said pair of bearings are disposed such that a line may be drawn parallel to said axis which intersects each of said pair of circumferential protrusions and each of said pair of bearings; and e) a substance which comprises metal and which is liquid at said operating temperature, wherein said substance is longitudinally disposed between said circumferential protrusions and wherein said substance radially extends a second radial distance between, and in conductive thermal contact with, said shaft and said stator.

3. The X-ray tube assembly of claim 2, wherein each of said pair of circumferential protrusions has a portion which is facing the other of said shaft and said stator and which is coated with an anti-wetting agent.

4. The X-ray tube assembly of claim 2, wherein said substance is liquid at room temperature.

5. The X-ray tube assembly of claim 4, wherein said bearings are ceramic bearings.

6. The X-ray tube assembly of claim 2, wherein said circumferential protrusions are disposed longitudinally between said bearings.

7. The X-ray tube assembly of claim 2, wherein said circumferential protrusions are disposed longitudinally outward of, and to one longitudinal side of, said pair of bearings.

* * * * *